US006022059A

United States Patent [19]

Regamey

[11] Patent Number: 6,022,059

[45] Date of Patent: Feb. 8, 2000

[54] METHOD AND APPARATUS FOR TEMPORARILY ATTACHING A ROPE TO A VERTICAL SUPPORT

[76] Inventor: Marc James Regamey, #3M 51114 Range Road 264, Spruce Grove, Alberta, Canada, T7Y 1E8

[21] Appl. No.: 08/792,666

[22] Filed: Jan. 31, 1997

[30] Foreign Application Priority Data

Feb. 12, 1996 [CA] Canada ..... 216906

[51] Int. Cl.[7] ..... B25J 1/04

[52] U.S. Cl. ..... 294/24; 24/129 R; 294/19.1

[58] Field of Search ..... 294/15, 19.1, 24, 294/26; 24/115 R, 115 H, 128, 129 R, 129 A; 114/221 R, 230; 248/353; 289/13, 17, 18.1

[56] References Cited

U.S. PATENT DOCUMENTS

| | | | |
|---|---|---|---|
| 149,575 | 4/1874 | Clendaniel et al. | 294/19.1 |
| 315,859 | 4/1885 | Travers | 24/129 R |
| 520,706 | 5/1894 | Redmond | 294/24 |
| 1,085,729 | 2/1914 | Gore | 24/129 R X |
| 1,202,580 | 10/1916 | Phelps | 24/129 R X |
| 1,951,898 | 3/1934 | Brorby | 248/353 X |
| 2,096,244 | 10/1937 | Heinrich | 294/19.1 X |
| 2,486,276 | 10/1949 | Guy | 24/129 R X |
| 3,866,965 | 2/1975 | Homeier | 294/19.1 |
| 4,895,407 | 1/1990 | Mozer | 294/19.1 |
| 5,622,399 | 4/1997 | Albright | 294/19.1 X |

*Primary Examiner*—Johnny D. Cherry
*Attorney, Agent, or Firm*—Anthony R. Lambert

[57] ABSTRACT

This is a method and apparatus for temporarily securing ropes to trees or other free standing vertical supports, eliminating the need to climb or use a ladder. The method uses a pole mounted yoke in conjunction with two poles. From ground level one can easily secure a rope six feet or more above one's reach. The only height limit is the length of the poles that are used.

8 Claims, 8 Drawing Sheets

METHOD AND APPARATUS FOR TEMPORARILY ATTACHING A ROPE TO A VERTICAL SUPPORT

FIELD OF THE INVENTION

The present invention relates to a method and apparatus for temporarily attaching a rope to a vertical support, such as a tree, where the required elevation for the rope to be anchored above ground level exceeds one's reach.

BACKGROUND OF THE INVENTION

It is common practice for campers to temporarily anchor tarpaulins and such to trees and other free standing vertical supports using ropes. Presently the procedures used to anchor and remove these ropes above one's maximum reach are to either stand on another person's shoulders, or park a vehicle next to the tree and stand on top of the vehicle. Procedures such as these are quite hazardous. A person could slip and fall off the vehicle or from the shoulders of the person supporting them.

SUMMARY OF THE INVENTION

What is required is a method of securing a rope to a tree, at a height that exceeds ones reach, which can be effected from ground level.

According to one aspect of the present invention there is provided a method for temporarily attaching a rope to a vertical support, such as a tree. In order to attempt the described method there first must be provided a rope and a rope attachment kit which includes a yoke, a first pole and a second pole. The yoke includes an elongate body having a first end and a second end. Means for engaging a rope project radially from the elongate body. The rope engaging means are spaced from the first end. Means for interlocking with a pole are positioned at the second end of the elongate body. Means for receiving a hook depend from the elongate body. The first pole has a first end and a second end. The first end has interlocking means compatible with the interlocking means at the second end of the elongate body of the yoke. The second pole has a first end and a second end. The first end has rope engaging means. It is preferred that one of the first pole and second pole also have a hook at the second end.

The rope and the rope attachment kit are used to attach the rope to a vertical support, such as a tree, according to the following method steps. Firstly, tying a first loop at an end of the rope and positioning the rope as a second loop around a vertical support. Secondly, forming a third loop and extending the third loop into the first loop. Thirdly, extending a first end of the yoke into the third loop until the rope is engaged by the rope engaging means. Fourthly, drawing the third loop tight to capture the first end of the yoke and coupling the interlocking means of the first pole with the interlocking means of the pole mounted apparatus. Fifthly, engaging the rope with the rope engaging means of the second pole, and using the second pole to lift the rope to a desired height on the vertical support while concurrently using the first pole to lift the pole mounted yoke to said desired height. Sixthly, drawing the second loop tight and removing the second pole and the first pole, thereby leaving the rope held by the yoke to the vertical support.

With the method, as described above, a rope may be positioned at a desired height on a tree while standing at ground level. Utilizing the pole mounted yoke and two poles, the rope may be raised five to six feet above one's outstretched arms while comfortably standing on the ground with neither strain nor hazard. When the rope is subsequently to be taken down it is possible to knock the yoke out of position by hitting it with a stick. Even more beneficial results may be obtained, however, when the step of removing the rope from the tree involves catching the hook receiving means on the yoke with the hook at the second end of one of the first pole and the second pole and using the hook to pull the yoke out of the third loop.

According to another aspect of the present invention there is provided the kit, as described above.

According to yet another aspect of the present invention there is provided the key component of the kit, that being the yoke.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
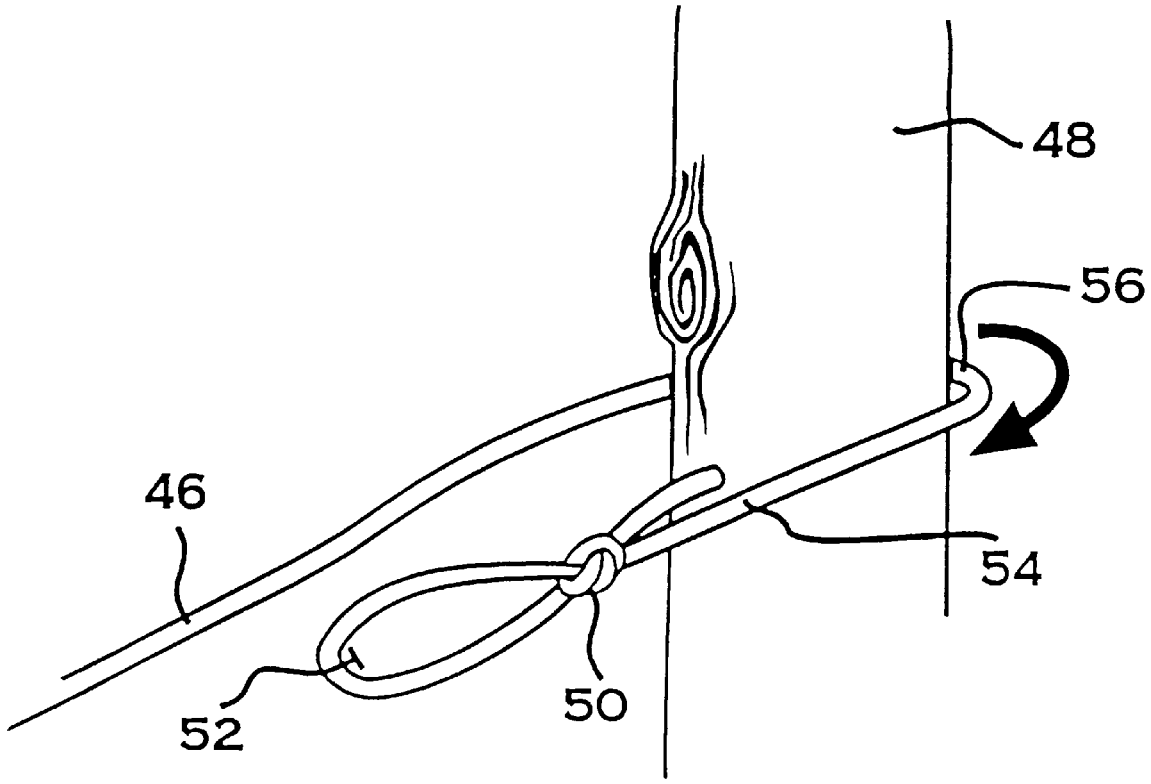
FIG. 1 is a perspective view illustrating a first step of a method of temporarily attaching a rope to a vertical support.

The preferred embodiment, a kit for temporarily attaching a rope to a vertical support will now be described with reference to FIGS. 1 through 8.

The kit includes a pole mounted yoke 10, a first pole 12 and a second pole 14. Referring to FIGS. 3 through 8, yoke 10 has an elongate cylindrical body 16 with a first end 18 and a second end 20. Two radially projecting arms 22 and 24 are spaced from first end 18. Radially projecting arms 22 and 24 serve as means for engaging a rope, as will hereinafter be further described. A female coupling 26 is positioned at second end 20. Female coupling 26 serves as means for interlocking with first pole 12, as will hereinafter be further described. A cord loop 28 extends through a transverse passage 30 in body 16. Loop 28 is of such a length that it depends from body 16, to serve as a hook receiving means as will hereinafter be further described. First pole 12 has a first end 32 and a second end 34. First end 32 has a male coupling 36 that is capable of mating with female coupling 26 at second end 20 of body 16 of yoke 10. Second pole 14 has a first end 38 and a second end 40. First end 38 has a transverse slot 42 which serves as rope engaging means as will hereinafter be further described. One of first pole 12 and second pole 14 has a hook 44 at second end 34 and 40, respectively. In the illustrated embodiment second end 40 of second pole 14 is illustrated as having hook 44.

Figure 2:
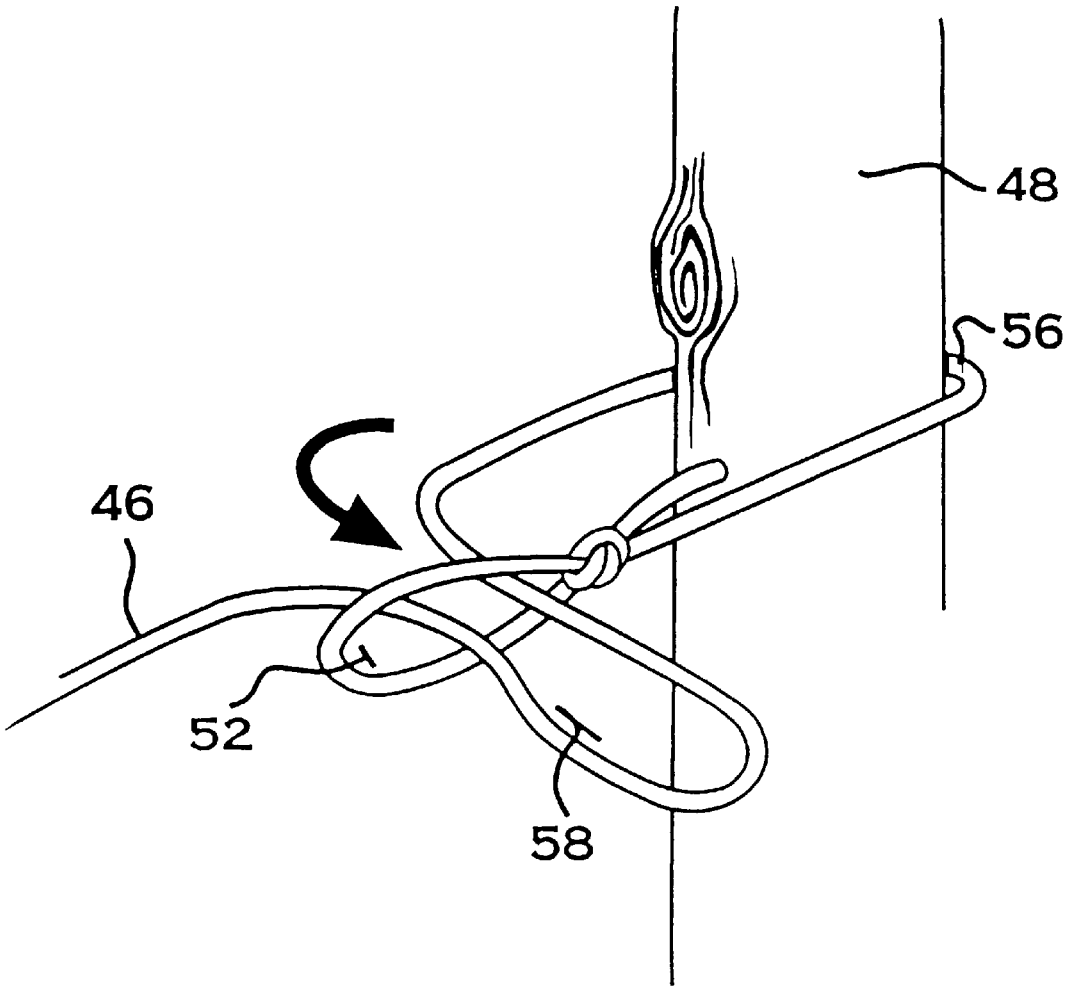
FIG. 2 is a perspective view illustrating a second step of a method of temporarily attaching a rope to a vertical support.
Figure 3:
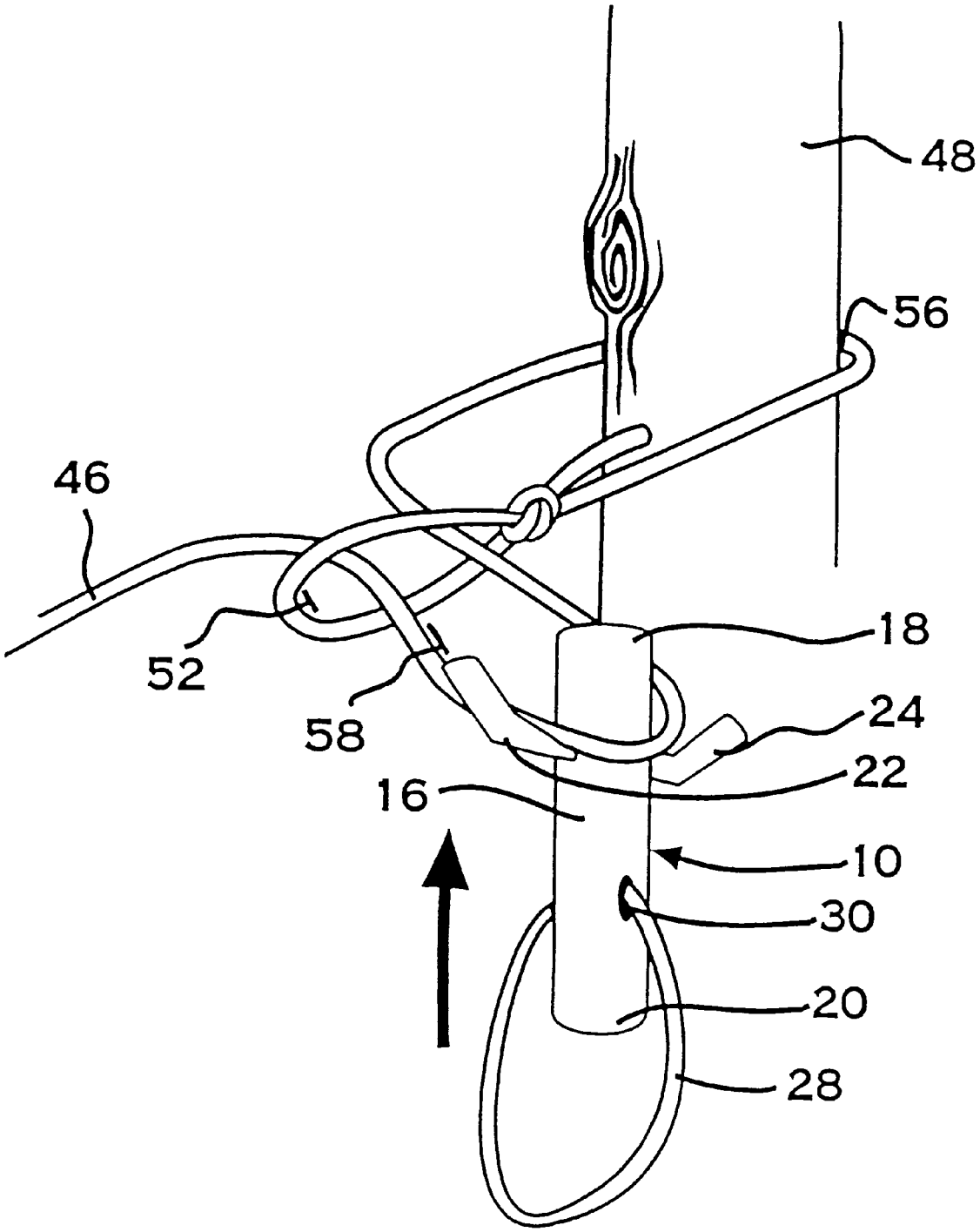
FIG. 3 is a perspective view illustrating a third step of a method of temporarily attaching a rope to a vertical support.
Figure 4:
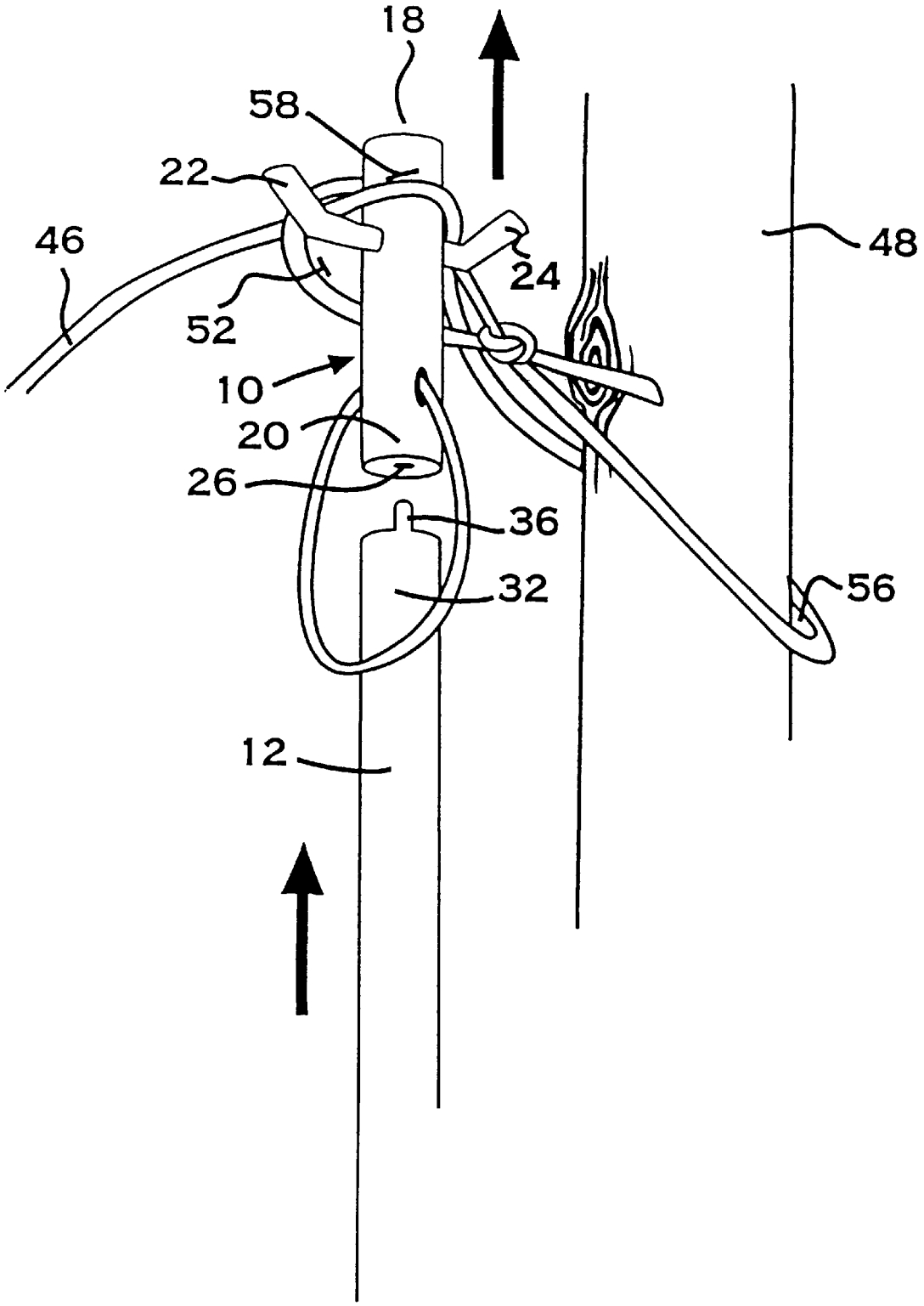
FIG. 4 is a perspective view illustrating a fourth step of a method of temporarily attaching a rope to a vertical support.
Figure 5:
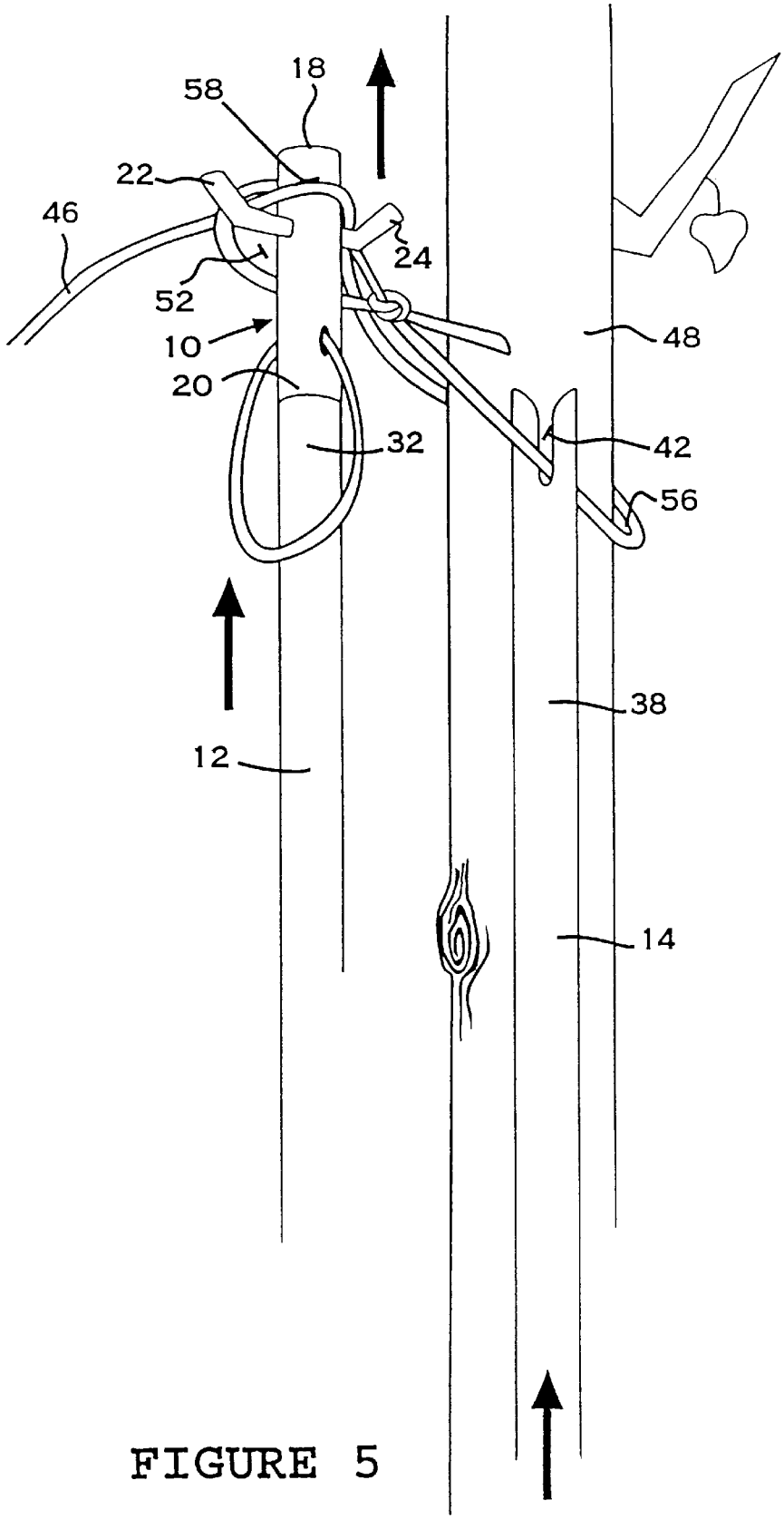
FIG. 5 is a perspective view illustrating a fifth step of a method of temporarily attaching a rope to a vertical support.
Figure 6:
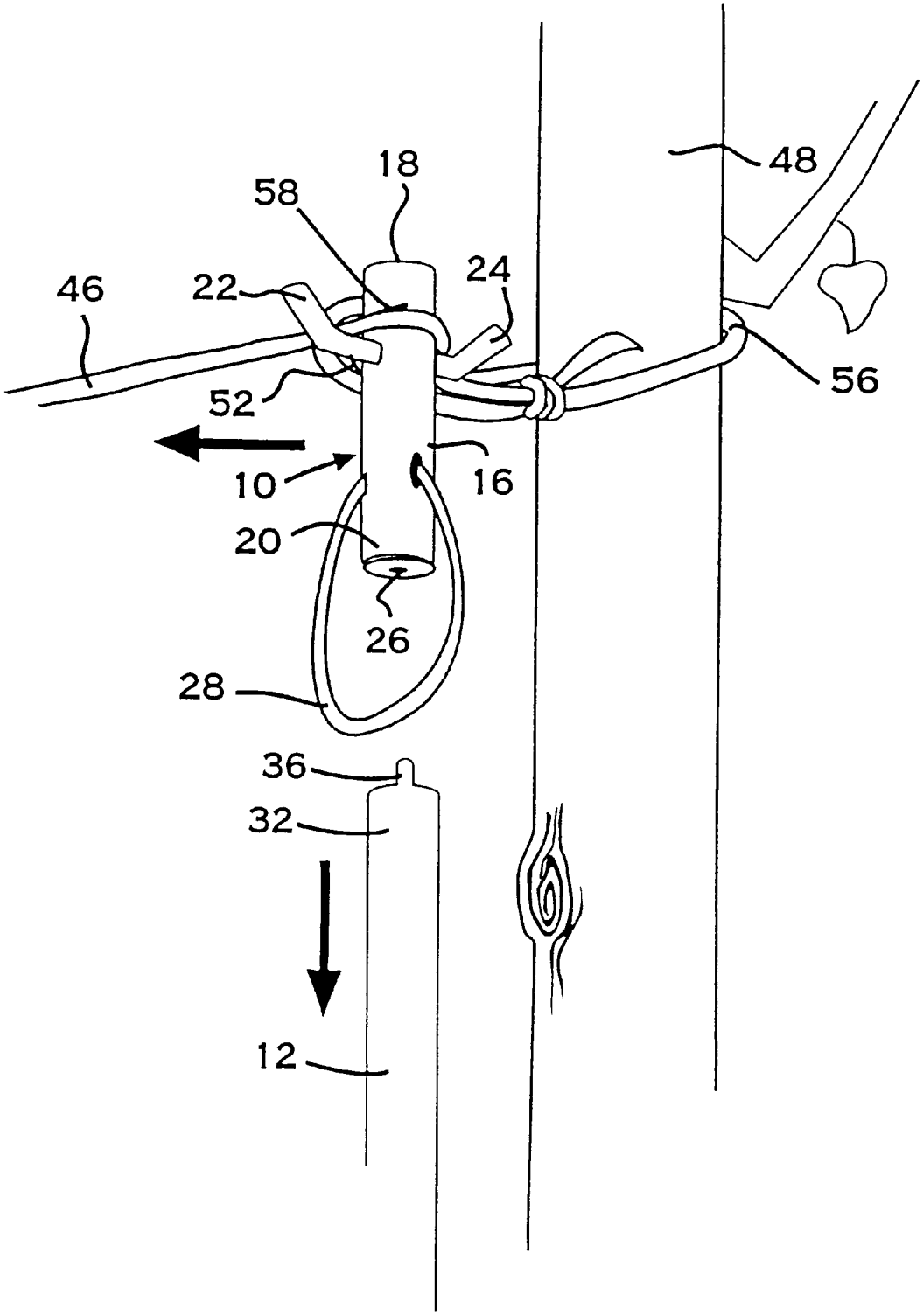
FIG. 6 is a perspective view illustrating a sixth step of a method of temporarily attaching a rope to a vertical support.
Figure 7:
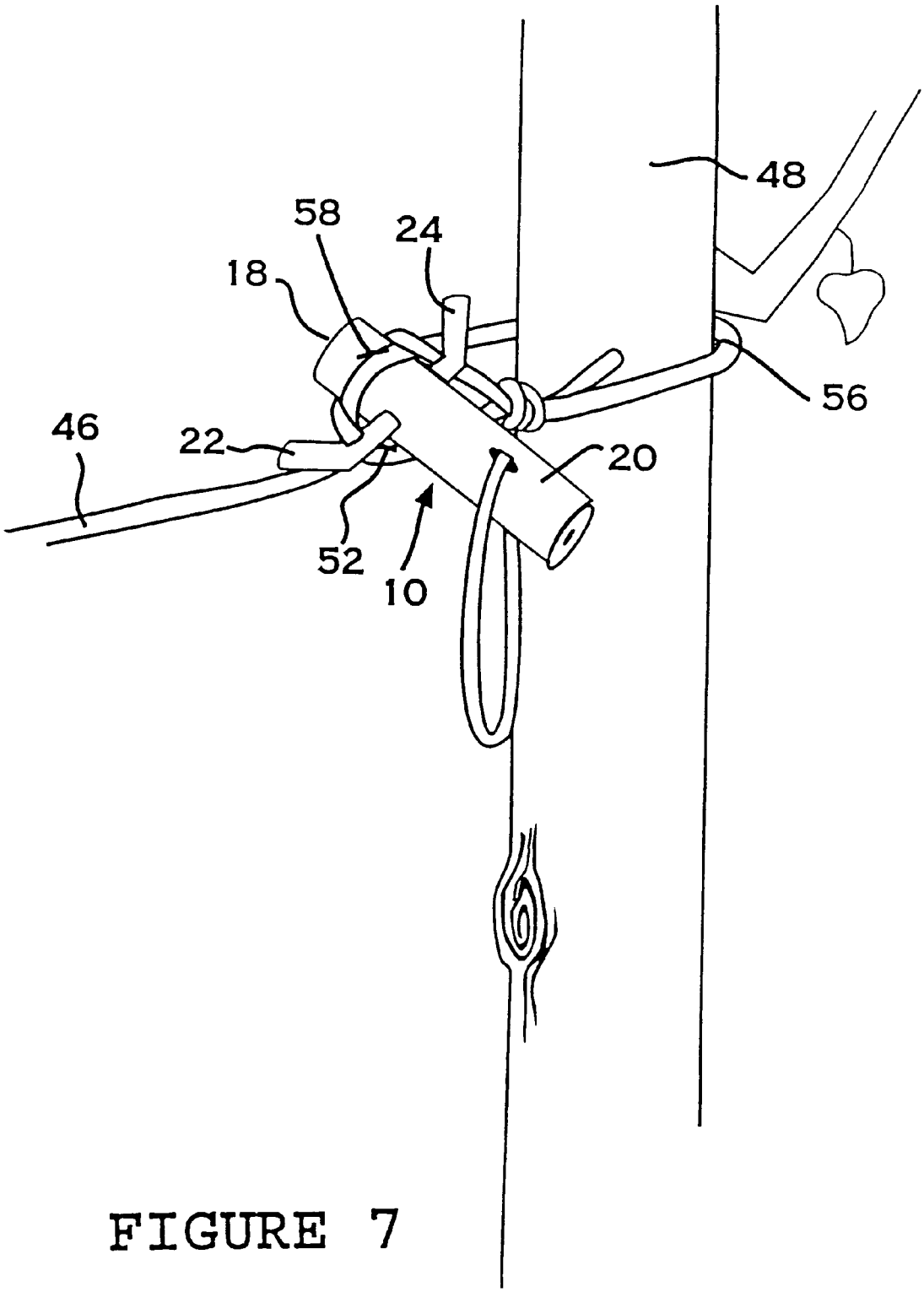
FIG. 7 is a perspective view illustrating a rope temporarily attached to a vertical support in accordance to the teachings of the present invention.
Figure 8:
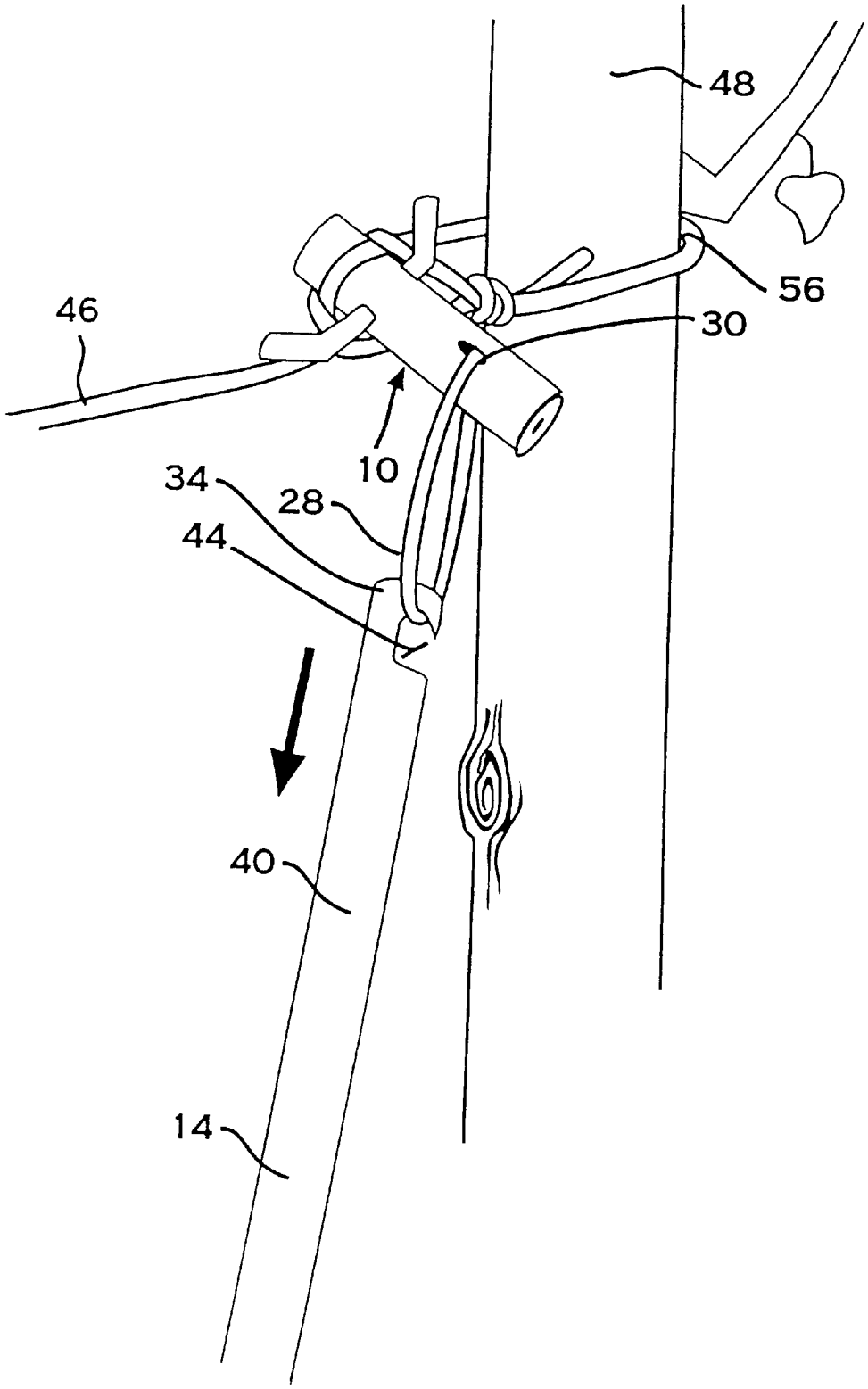
FIG. 8 is a perspective view illustrating a method of removing the rope illustrated in FIG. 7.

Using a rope 46 and the rope attachment kit described above, rope 46 may be temporarily attached to a vertical support 48, such as a tree, according to the following method steps. Firstly, tying a knot 50 to form a first loop 52 at an end 54 of rope 46 and positioning rope 46 as a second loop 56 around vertical support 48, as illustrated in FIG. 1. Secondly, forming a third loop 58 and extending third loop 58 into first loop 52, as illustrated in FIG. 2. Thirdly, extending first end 18 of yoke 10 into third loop 58 until rope 46 is engaged by arms 22 and 24, as illustrated in FIG. 3. Fourthly, drawing third loop 58 tight to capture first end 18 of yoke 10 and coupling male coupling 36 of first pole 12 with female coupling 26 of yoke 10, as illustrated in FIG. 4. Fifthly, engaging rope 46 in transverse slot 42 of second pole 14, and using second pole 14 to lift rope 46 to a desired height on vertical support 48 while concurrently using first pole 12 to lift yoke 10 to said desired height, as illustrated in FIG. 5. Sixthly, drawing second loop 56 tight and removing second pole 14 and first pole 12, thereby leaving rope 46 secured solely by yoke 10 to vertical support 48, as illustrated in FIGS. 6 and 7. By following the method steps described, rope 46 can be secured to vertical support 48, (typically, a tree) in a campground at a height of 5 or 6 feet above one's reach while standing at ground level. When it is time to leave the campground and rope 46 is to be removed, this is accomplished by catching loop 28 which depends from yoke 10 with hook 44, and using hook 44 to pull yoke 10 out of third loop 58, as illustrated in FIG. 8.

Although the present invention was initially developed for the purpose of temporarily anchoring tarpaulins to trees, there are numerous other uses. Over the course of a season, the knots holding a hammock in place become impossible to untie. This problem can be avoided by securing the hammock in place with the present invention. When felling a tree, it is important to control the direction in which the tree falls. This can be accomplished by securing a line to the tree in accordance with the teachings of the present invention. Experienced campers do not keep food in their tents, as the food tends to attract bears and other animals. As a safety measure, food is suspended in a tree at a reasonable distance from the tents. The present invention can be used to suspend the food. Once a hunter has killed a deer or moose, he generally takes steps to suspend the carcass. The present invention can be used to suspend the carcass in preparation for preliminary butchering.

Once weight has been placed upon yoke 10, it becomes very difficult to knock yoke 10 out of position. The greater the weight applied to yoke 10, the more important it becomes to be able to apply a force to pull yoke 10 out of position. Although this could be accomplished by re-engaging male coupling 36 on pole 12 with female coupling 26 on yoke 10, the use of hook 44 is preferred for a number of reasons. It is difficult to re-engage male coupling 36 with female coupling 26 from ground level. A pulling force can place a strain upon the threaded engagement between male coupling 36 and female coupling 26.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A kit for temporarily attaching a rope to a vertical support, comprising:

a. a pole mounted yoke, including:

an elongate body having a first end and a second end;

first rope enraging means for engaging a rope projecting radially from the elongate body, the first rope engaging means being spaced from the first end;

means for interlocking with a pole at the second end of the elongate body; and means for receiving a hook;

b. a first pole having a first end and a second end, the first end having interlocking means compatible with the interlocking means at the second end of the elongate body of the yoke;

c. a second pole having a first end and a second end, the first end having second rope engaging means;

d. one of the first pole and second pole having a hook at the second end.

2. The kit as defined in claim 1, wherein the second rope engaging means is a transverse slot.

3. The kit as defined in claim 1, wherein the interlocking means on one of the first pole and the yoke is a female coupling, and the interlocking means on the other of the first pole and the yoke is a male coupling.

4. The kit as defined in claim 1, wherein the hook receiving means on the yoke is in the form of a loop.

5. The kit as defined in claim 1, wherein the first rope engaging means on the pole mounted yoke are at least two radially projecting arms.

6. A method for temporarily attaching a rope to a vertical support, comprising the following steps:

providing a rope;

providing a rope attachment kit which includes:

a. pole mounted yoke, including:

an elongate body having a first end and a second end;

first rope engaging means for engaging a rope projecting radially from the elongate body, the first rope engaging means being spaced from the first end;

means for interlocking with a pole at the second end of the elongate body; and means for receiving a hook;

b. a first pole having a first end and a second end, the first end having interlocking means compatible with the interlocking means at the second end of the elongate body of the yoke;

c. a second pole having a first end and a second end, the first end having second rope engaging means;

d. one of the first pole and second pole having a hook at the second end;

using the rope and the rope attachment kit to attach the rope to a vertical support according to the following method steps:

firstly, tying a first loop at an end of the rope and positioning the rope as a second loop around the vertical support;

secondly, forming a third loop and extending the third loop into the first loop;

thirdly, extending a first end of the yoke into the third loop until the rope is engaged by the first rope engaging means;

fourthly, drawing the third loop tight to capture the first end of the yoke and coupling the interlocking means of the first pole with the interlocking means of the pole mounted yoke;

fifthly, engaging the rope with the second rope engaging mean of the second pole, and using the second pole to lift the rope to a desired height on the vertical support while concurrently using the first pole to lift the pole mounted yoke to said desired height; and sixthly, drawing the second loop tight and removing the second pole and the first pole, thereby leaving the rope held by the yoke to the vertical support.

7. The method as defined in claim 6, including a further step of removing the rope from the vertical support by catching the hook receiving means on the yoke with the hook at the second end of one of the first pole and the second pole and using the hook to pull the yoke out of the third loop.

8. A method for temporarily attaching a rope to a vertical support, comprising the following steps:

providing a rope;

providing a pole mounted member having first rope engaging means for engaging a rope and means for interlocking the pole mounted member with a pole;

providing a first pole having means for interlocking with the pole mounted member;

providing a second pole having second rope engaging means;

tying a first loop at an end of the rope and positioning the rope as a second loop around the vertical support;

forming a third loop and extending the third loop into the first loop;

extending the pole mounted member into the third loop until the rope is engaged by the first rope engaging means;

drawing the third loop tight to capture the pole mounted member and coupling the interlocking means of the first pole with the interlocking means of the pole mounted member;

engaging the rope with the second rope engaging means of the second pole, and using the second pole to lift the rope to a desired height on the vertical support while concurrently using the first pole to lift the pole mounted member to said desired height; and drawing the second loop tight and removing the second pole and the first pole, thereby leaving the rope held by the pole mounted member to the vertical support.

* * * * *